US012421816B2

(12) United States Patent
Liang

(10) Patent No.: US 12,421,816 B2
(45) Date of Patent: Sep. 23, 2025

(54) ANCHORING SUBASSEMBLY INCLUDING A RELAXATION MECHANISM

(71) Applicant: Halliburton Energy Services, Inc., Houston, TX (US)

(72) Inventor: Aihua Liang, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/492,474

(22) Filed: Oct. 23, 2023

(65) Prior Publication Data

US 2024/0141741 A1 May 2, 2024

Related U.S. Application Data

(60) Provisional application No. 63/419,516, filed on Oct. 26, 2022.

(51) Int. Cl.
*E21B 23/01* (2006.01)
*E21B 7/06* (2006.01)

(52) U.S. Cl.
CPC ..... *E21B 23/01* (2013.01); *E21B 7/061* (2013.01)

(58) Field of Classification Search
CPC ..... E21B 23/01; E21B 7/061
See application file for complete search history.

(56) References Cited

U.S. PATENT DOCUMENTS

| | | | | |
|---|---|---|---|---|
| 5,046,557 | A * | 9/1991 | Manderscheid | E21B 33/1295 166/134 |
| 5,107,930 | A | 4/1992 | Hopper | |
| 5,526,884 | A * | 6/1996 | Lembcke | E21B 23/01 166/120 |
| 6,283,208 | B1 | 9/2001 | George et al. | |
| 10,920,510 | B2 * | 2/2021 | Egleton | E21B 23/04 |
| 2012/0181045 | A1 | 7/2012 | Thomas et al. | |
| 2014/0131106 | A1 | 5/2014 | Coull et al. | |
| 2015/0047840 | A1 | 2/2015 | Hurtado | |
| 2018/0274316 | A1 * | 9/2018 | Dancer | E21B 47/12 |
| 2023/0107931 | A1 | 4/2023 | Liang et al. | |
| 2023/0110168 | A1 | 4/2023 | Vemuri et al. | |
| 2023/0113169 | A1 | 4/2023 | Vemuri et al. | |

* cited by examiner

*Primary Examiner* — D. Andrews
(74) *Attorney, Agent, or Firm* — Scott Richardson; Parker Justiss, P.C.

(57) ABSTRACT

Provided is an anchoring subassembly, a well system, and a method. The anchoring subassembly, in one aspect, includes an energizer sub that is in sliding engagement with a connector sub, a latch housing, and one or more latching features supported by the latch housing, the one or more latching features operable to move between a radially retracted state and a radially expanded state. The anchoring subassembly, further includes a spring member positioned within a space between the latch housing and the energizer sub, and a ramp member positioned within the space between the latch housing and the energized sub and between the spring member and the one or more latching features. The anchoring subassembly, according to this aspect, further includes a relaxation mechanism coupled to the connector sub, the relaxation mechanism configured to relax to allow the one or more latching features to return toward their radially retracted state.

17 Claims, 19 Drawing Sheets

ANCHORING SUBASSEMBLY INCLUDING A RELAXATION MECHANISM

CROSS-REFERENCE TO RELATED APPLICATION

This application claims the benefit of U.S. Provisional Application Ser. No. 63/419,516, filed on Oct. 26, 2022, entitled "ANCHORING SUBASSEMBLY INCLUDING A RELAXATION MECHANISM," commonly assigned with this application and incorporated herein by reference in its entirety.

BACKGROUND

The unconventional market is extremely competitive. The market is trending towards longer horizontal wells to increase reservoir contact. Multilateral wells offer an alternative approach to maximize reservoir contact. Multilateral wells include one or more lateral wellbores extending from a main wellbore. A lateral wellbore is a wellbore that is diverted from the main wellbore or another lateral wellbore.

The lateral wellbores are typically formed by positioning one or more deflector assemblies at desired locations in the main wellbore (e.g., an open hole section or cased hole section) with a running tool. The deflector assemblies are often laterally and rotationally fixed within the main wellbore using a wellbore anchor, and then used to create an opening in the casing.

BRIEF DESCRIPTION

Reference is now made to the following descriptions taken in conjunction with the accompanying drawings, in which:

FIG. 1 illustrates a schematic view of a well system designed, manufactured and operated according to one or more embodiments disclosed herein;

FIGS. 2A and 2B illustrated one embodiment of a whipstock assembly designed, manufactured and/or operated according to one or more embodiments of the disclosure;

DETAILED DESCRIPTION

Figure 1:
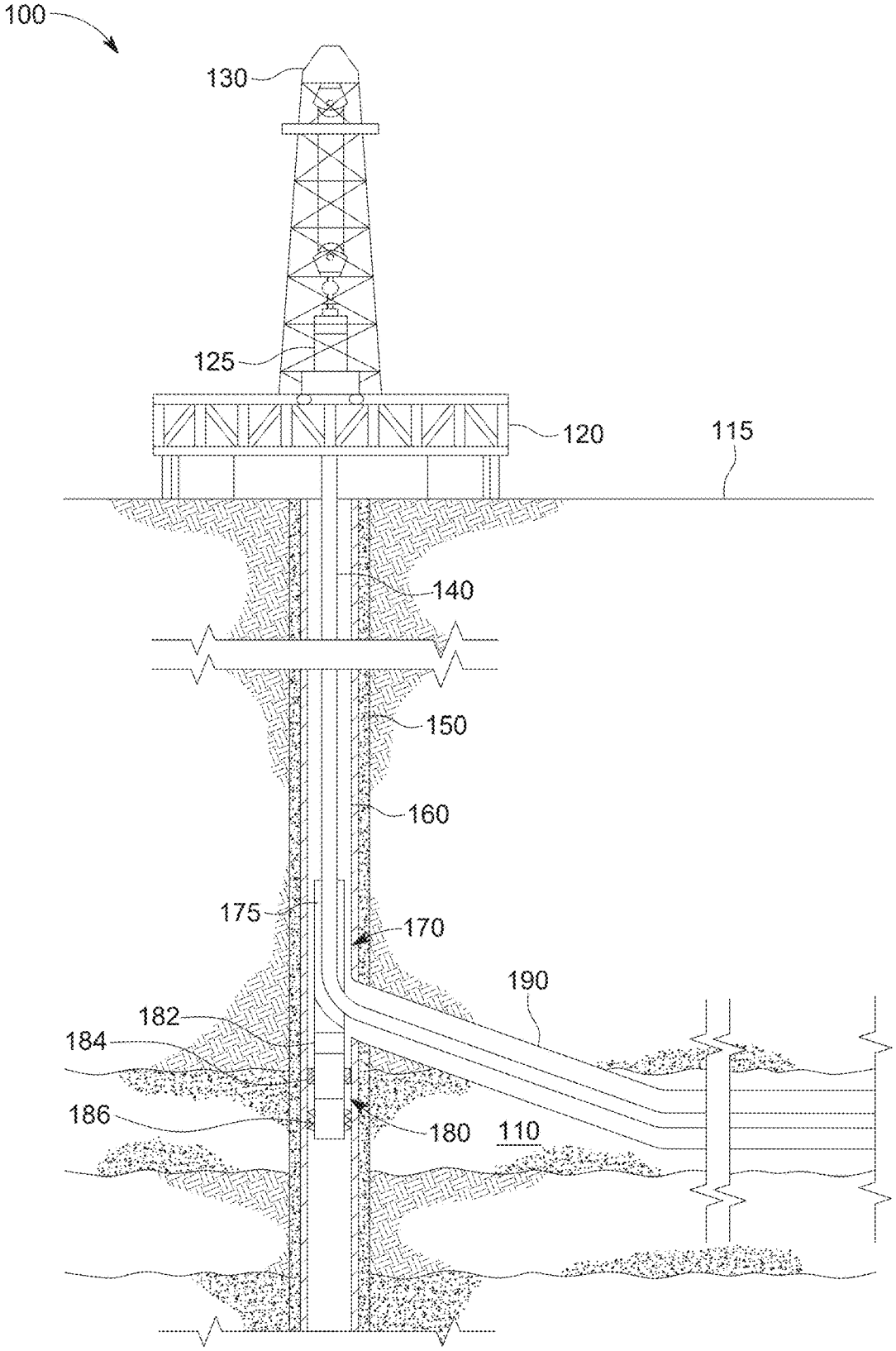

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements, and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water, such as ocean or fresh water.

The present disclosure is based, at least in part, on a relaxation mechanism used in an anchoring subassembly of a whipstock assembly. For example, a relaxation mechanism according to the present disclosure may be used in high angle (e.g., currently greater than 45 degrees, if not greater than 50 degrees, if not greater than 60 degrees, if not 65 degrees or greater) latch assemblies, which will typically have a high un-latch load. The relaxation mechanism, according to one or more embodiments, may include: 1) an ability to shear and relax a spring member so that the anchoring subassembly (e.g., and whipstock assembly) can be pulled out if stuck in a latch coupling; 2) trip saving for replacing the emergency release mechanism above the anchoring subassembly; and 3) accurately predicting and adjusting the pulling load.

A high pull load anchoring subassembly may be used on the bottom of a whipstock assembly, as discussed above. The system may be first run-in-hole with a running tool, and then the isolation elements of the anchoring subassembly may be set, and thereafter a washover (or other contingency release) may be used to pull out the system from the latch coupling.

In at least one embodiment, an uphole portion of the whipstock element of the whipstock assembly has a shear bolt connecting to a milling system, and a downhole portion of the whipstock element of the whipstock assembly is coupled to the anchoring subassembly, for example including an orienting receptacle section, a sealing section, and a latching element section (e.g., which could include the relaxation mechanism according to one embodiment of the disclosure). In at least one embodiment, a downhole portion of the whipstock element couples with a collet profile in the orienting receptacle section of the anchoring subassembly. The anchoring subassembly latches and releases with a shear-to-set and shear-to-release mechanism. A middle section of the anchoring subassembly includes the sealing section with a shear-to-set and pull-to-relax of the isolation elements of the sealing section.

In at least one embodiment, since the whipstock assembly includes a series of shear mechanisms, the un-latch load would typically need to be higher than all the other shear mechanism ratings above them, so that the whipstock assembly will not be accidently pulled out during other shearing operations. If the un-latch load is not high enough to hold in the latch coupling in the wellbore casing, the whipstock assembly might be pulled out with the isolation elements (e.g., of the sealing section) expanded in the wellbore casing, which could cause swabbing. To accommodate this, a high degree latching element section was designed to have higher un-latch load.

However, while high un-latch loads address the previously discussed problems, based on previous field issue, the whipstock assembly (e.g., including the latching element section) might be stuck in the latch coupling of the wellbore casing. For example, cement and debris may surround the latching element section, which may more than double the un-latch load. Based upon the foregoing, the present disclosure has designed a latching element section having high pulling load, but one that also can be relaxed to let the latching elements (e.g., latch segments) collapse a little so that the whipstock assembly with the anchoring subassembly and latch element section can be pulled out when stuck.

Furthermore, for the sealing section of the anchoring subassembly, when run in smaller ID casing, the setting load necessary is much lower for the isolation elements to hold pressure, and the shear to relax load would be lower too. If the anchoring subassembly is run in larger casing ID, the setting load would be much higher, and the shear to relax load would be higher too. Moreover, for higher temperature, the setting load necessary is much lower for the isolation elements to hold pressure, whereas for lower temperature, the setting load necessary is much higher for the isolation elements to hold pressure. Thus, the setting and release load for the sealing section of the anchoring subassembly can be from lower to higher for different operation conditions. Also, the latching element section of the anchoring subassembly can be designed with much higher un-latch load (e.g., working for all the conditions described above), and the relaxation mechanism would provide the opportunity to adjust an un-latch load for each different operation conditions, as needed.

FIG. 1 is a schematic view of a well system 100 designed, manufactured and/or operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based or offshore-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

In the embodiment of FIG. 1, a whipstock assembly 170 according to one or more embodiments of the present disclosure is positioned at a location in the main wellbore 150. Specifically, the whipstock assembly 170 could be placed at a location in the main wellbore 150 where it is desirable for a lateral wellbore 190 to exit. Accordingly, the whipstock assembly 170 may be used to support a milling tool used to penetrate a window in the main wellbore 150, and once the window has been milled and a lateral wellbore 190 formed, in some embodiments, the whipstock assembly 170 may be retrieved and returned uphole by a retrieval tool.

The whipstock assembly 170, in at least one embodiment, includes a whipstock element section 175, as well as an anchoring/sealing subassembly 180 coupled to a downhole end thereof. The anchoring/sealing subassembly 180, in one or more embodiments, includes an orienting receptacle section 182, a sealing section 184, and a latching element section 186. In at least one embodiment, the latching element section 186 axially, and optionally rotationally, fixes the whipstock assembly 170 within the casing string 160. The sealing section 184, in at least one embodiment, seals (e.g., provides a pressure tight seal to) an annulus between the whipstock assembly 170 and the casing string 160. The orienting receptacle section 182, in one or more embodiments, along with a collet and one or more orienting keys, may be used to land and positioned a guided milling assembly and/or the whipstock element section 175 within the casing string 160.

The elements of the whipstock assembly 170 may be positioned within the main wellbore 150 in one or more separate steps. For example, in at least one embodiment, the anchoring sub assembly 180, including the orienting receptacle section 182, sealing section 184 and the latching element section 186 are run in hole first, and then set within the casing string 160. Thereafter, the sealing section 184 may be pressure tested. Thereafter, the whipstock element section 175 may be run in hole and coupled to the anchoring/sealing subassembly 180, for example using the orienting receptacle section 182. What may result is the whipstock assembly 170 illustrated in FIG. 1.

Figure 2A:
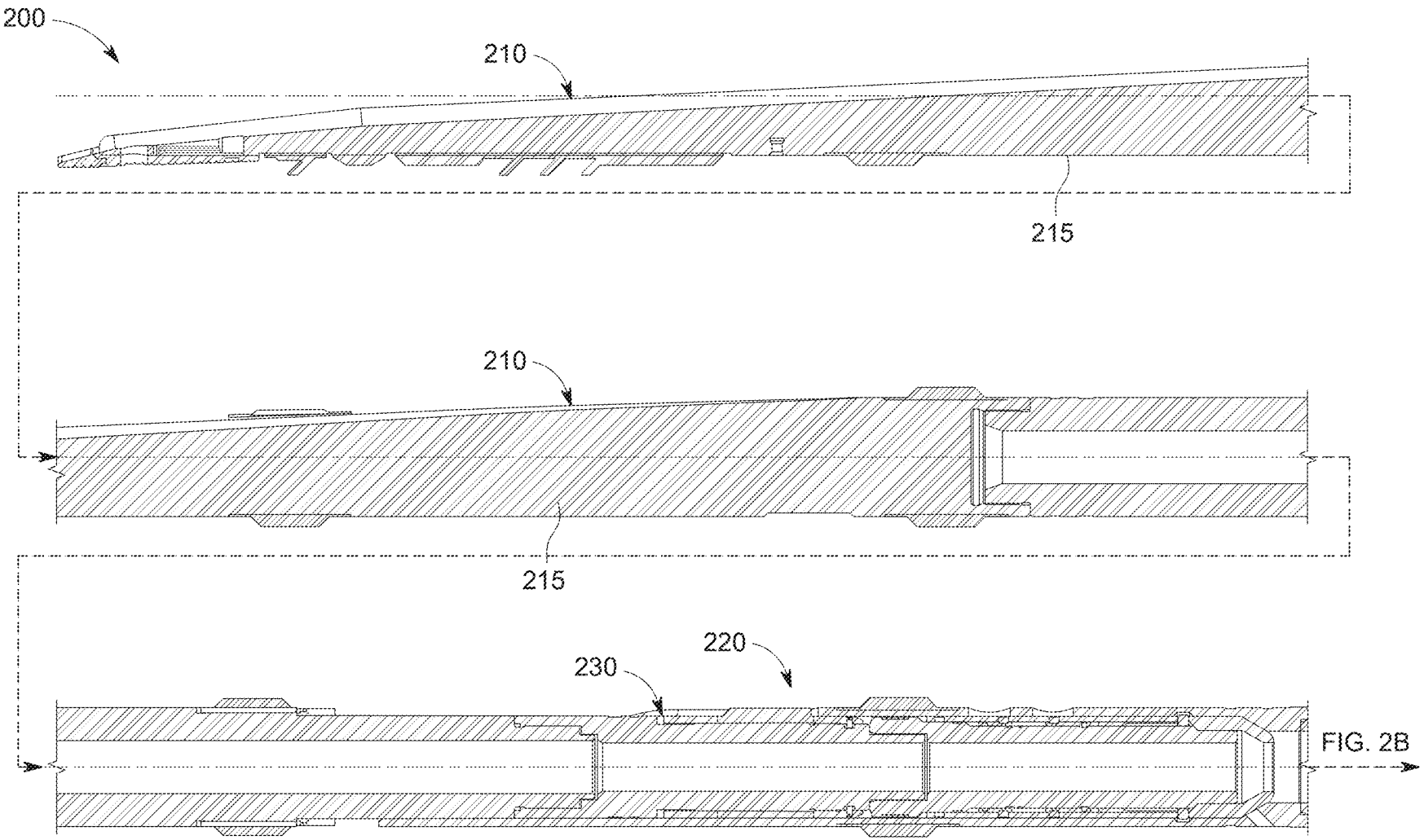
Figure 2B:
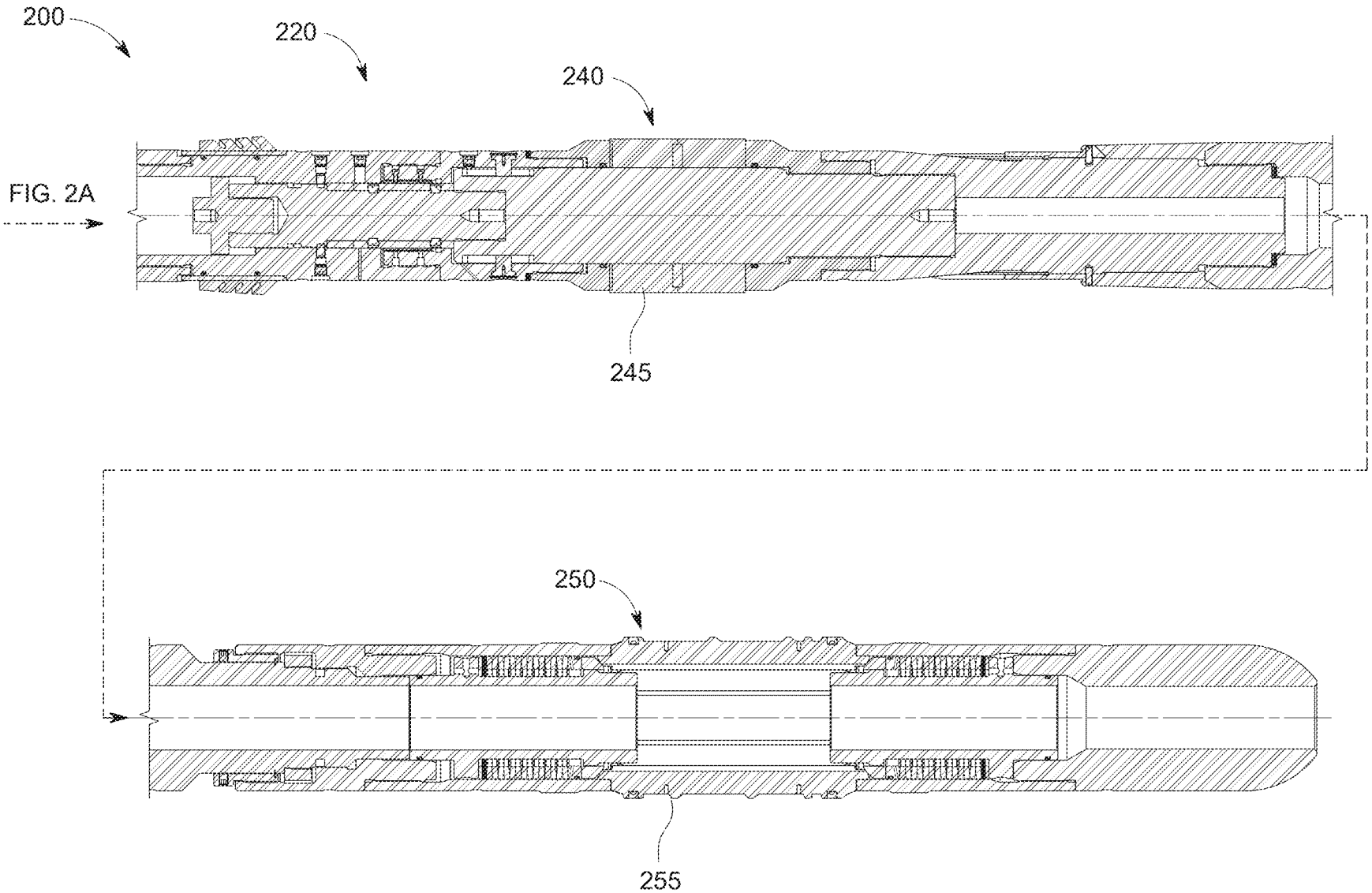

Turning now to FIGS. 2A and 2B, illustrated is one embodiment of a whipstock assembly 200 designed, manufactured and/or operated according to one or more embodiments of the disclosure. The whipstock assembly 200, in the illustrated embodiment of FIGS. 2A and 2B, includes a whipstock element section 210 and an anchoring subassembly 220. The whipstock element section 210, in the illustrated embodiment, includes a whipstock element 215 (e.g., ramp element). The anchoring subassembly 220, in one or more embodiments, includes an orienting receptacle section 230 (e.g., including a muleshoe), a sealing section 240, and a latching element section 250. The sealing section 240, in the illustrated embodiment, among other features disclosed below, includes an isolation element 245, the isolation element 245 configured to move between a radially retracted state and a radially expanded state. The latching element section 250, in the illustrated embodiment, includes one or more latching features 255 (e.g., latch segments), the one or more latching features 255 configured to engage with a profile (e.g., latch coupling) in a casing string. The latching element section 250, in one or more embodiments, may include a relaxation mechanism according to the disclosure.

Figure 3:
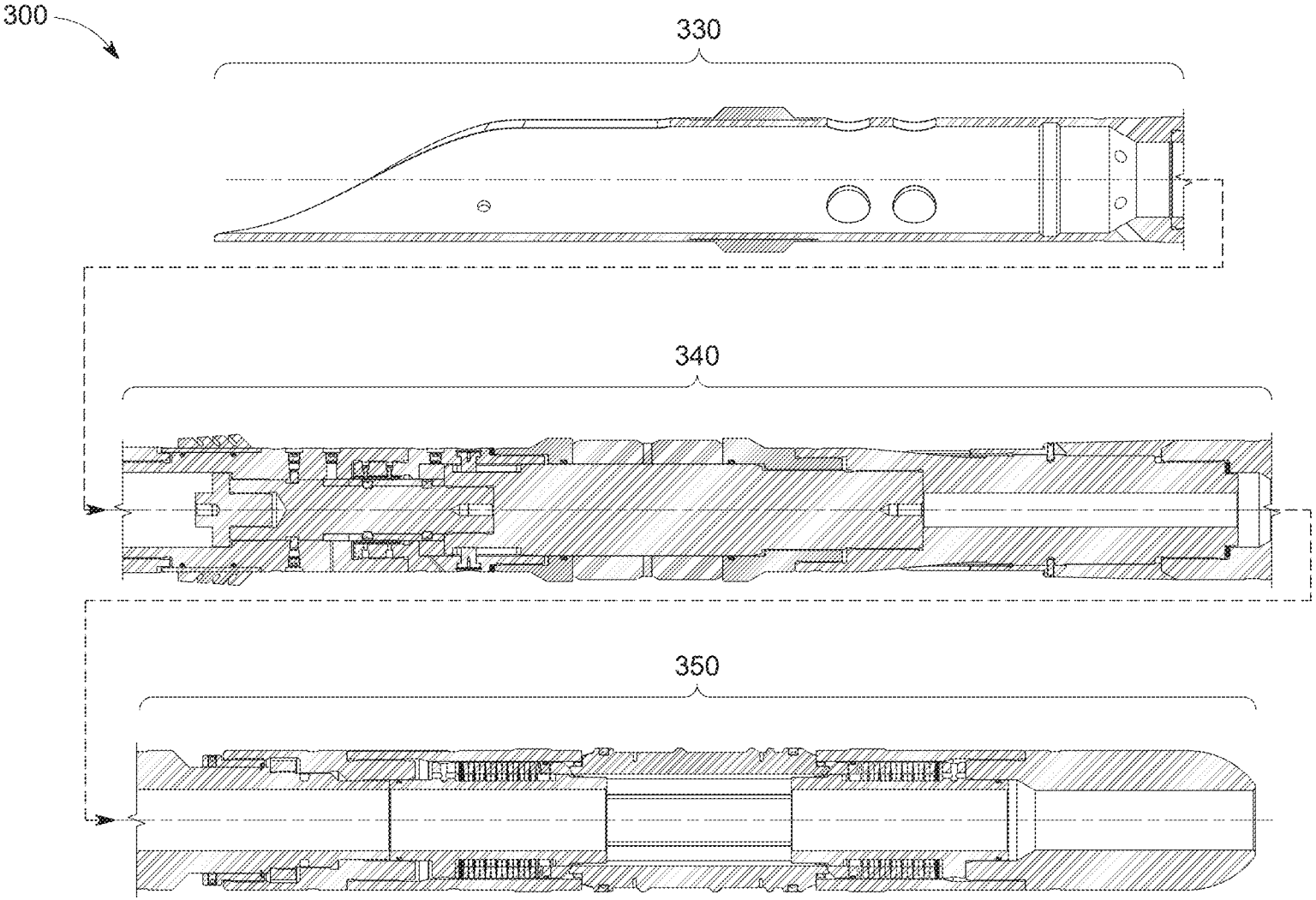
FIG. 3 illustrates an alternative embodiment of an anchoring subassembly, the anchoring subassembly including an orienting receptacle section, a sealing section, and a latching element section, all of which are designed, manufactured and/or operated according to an alternative embodiment of the disclosure.

Turning to FIG. 3, illustrated is an alternative embodiment of an anchoring subassembly 300, the anchoring subassembly including an orienting receptacle section 330, a sealing section 340, and a latching element section 350, all of which are designed, manufactured and/or operated according to an alternative embodiment of the disclosure. The orienting receptacle section 330, sealing section 340, and latching element section 350 may be run in hole within a main wellbore, set, and then pressure tested, prior to a whipstock element section (not shown in FIG. 3) of the whipstock assembly being run in hole and attached with the orienting receptacle section 330. Notwithstanding, FIG. 3 illustrates the latching element section 350 in the disengaged state, as well as the sealing section 340 in the radially retracted state.

Figure 4A:
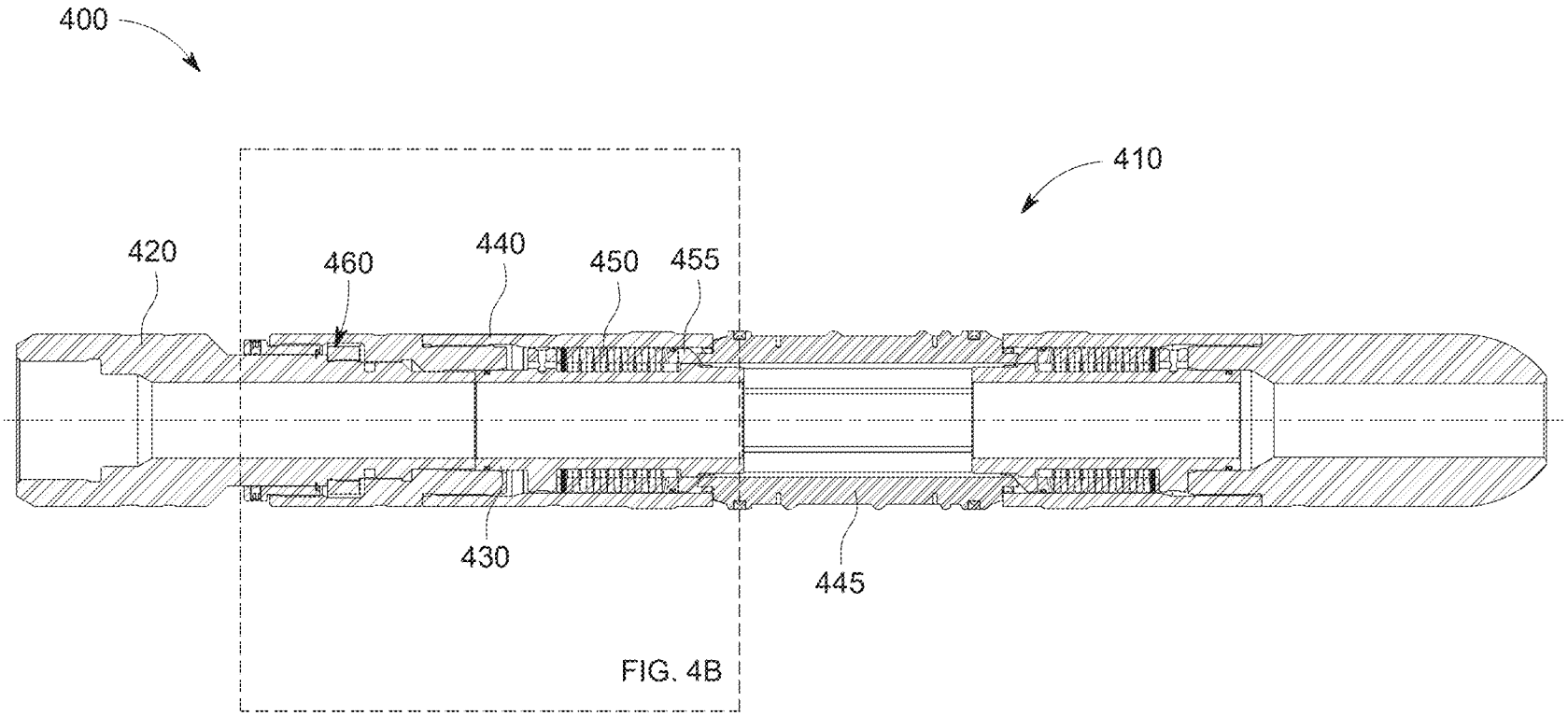
FIGS. 4A through 4C illustrate cross-sectional views of a portion of anchoring subassembly (e.g., latching element section of the anchoring subassembly) designed, manufactured and/or operated according to one or more embodiments of the disclosure.
Figure 4B:
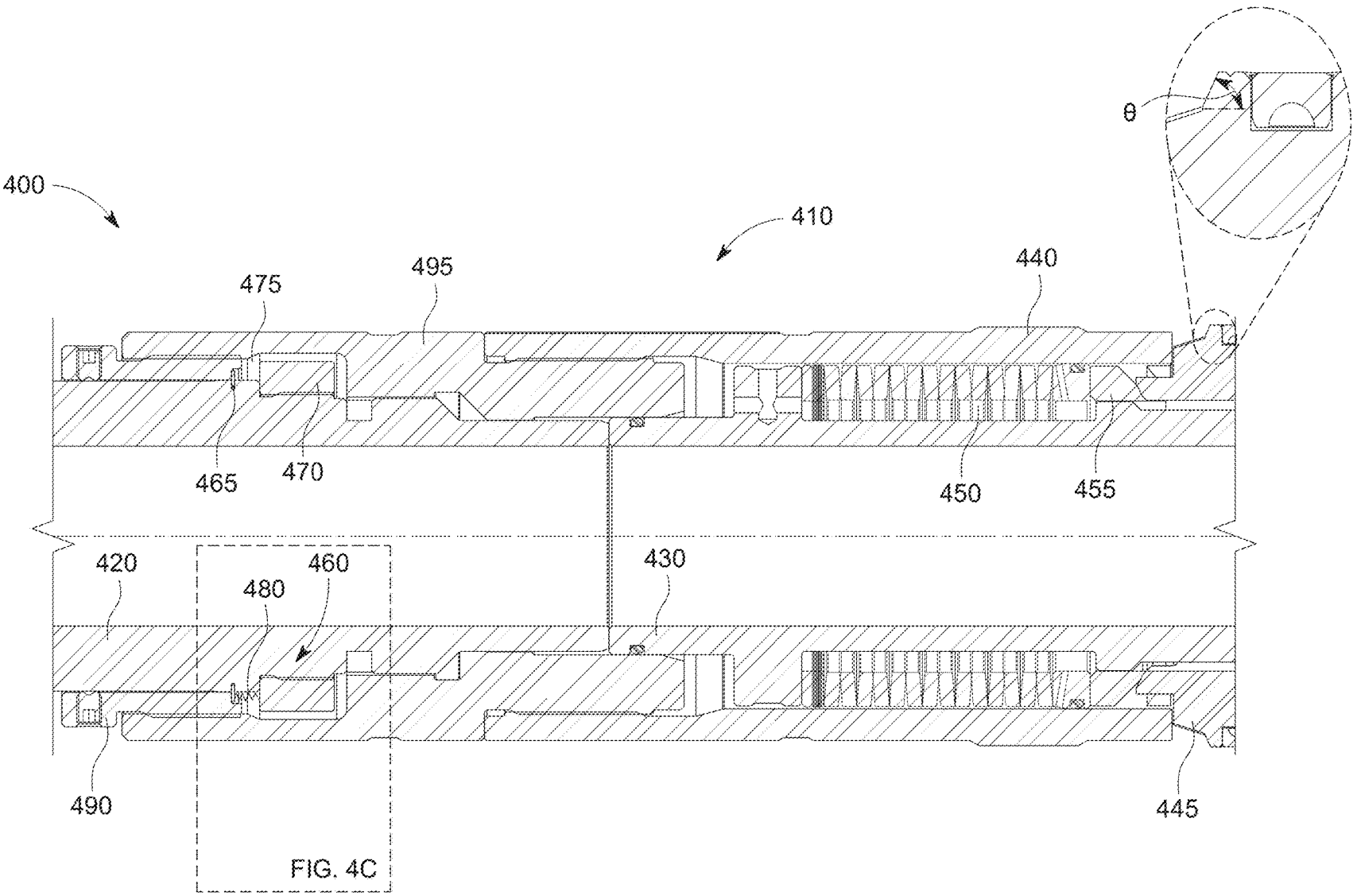
Figure 4C:
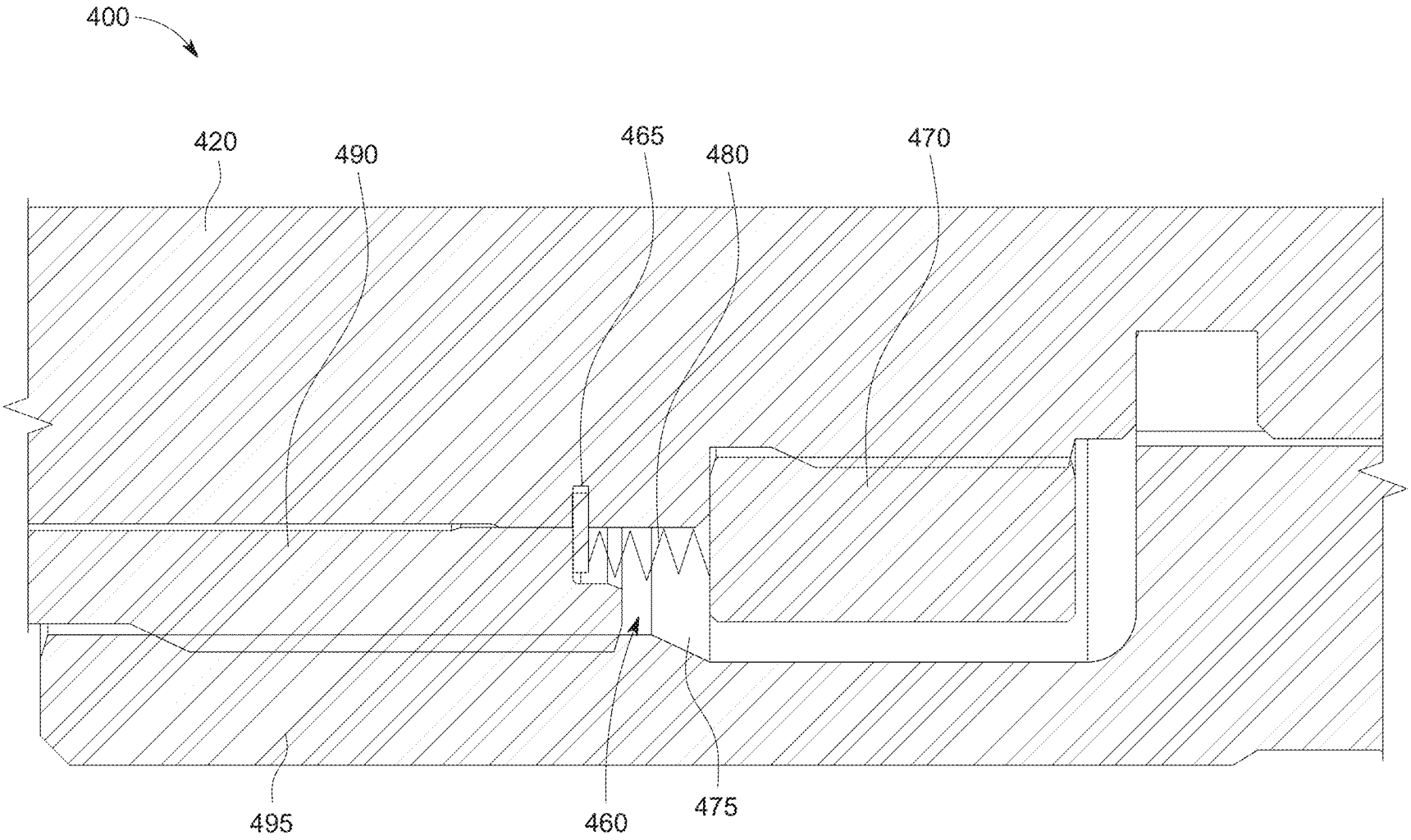

Turning to FIGS. 4A through 4C, illustrated are cross-sectional views of a portion of anchoring subassembly 400 (e.g., latching element section 410 of the anchoring subassembly 400) designed, manufactured and/or operated according to one or more embodiments of the disclosure. As illustrated, in one or more embodiments, the anchoring subassembly 400 includes a connector sub 420 that is in sliding engagement with an energizer sub 430. The anchoring subassembly 400 additionally includes, in the illustrated embodiment, a latch housing 440 that supports one or more latching features 445 (e.g., latch segments).

In at least one embodiment, a spring member 450 and a ramp member 455 are positioned in a space between the energizer sub 430 and the latch housing 440. Accordingly, when the connector sub 420 slides downhole, thus sliding the energizer sub 430 downhole, a shoulder in the energizer sub 430 compresses the spring member 450, which in turn moves the ramp member 455 downhole. As an angle surface of the ramp member 455 is engaged with the one or more latching features 445 (e.g., an angled surface of the one or more latching features 445), the compression of the spring member 450 and downward movement of the ramp member 455 move the one or more latching features 445 from their radially retracted state (e.g., as shown in FIGS. 4A and 4B) to their radially expanded state.

As indicated above, an angle (θ0) of the one or more latching features 445, which engages with the latch coupling in the casing, may be high in certain embodiments, thus setting up a situation where it is difficult to release the one or more latching features 445 from their radially expanded state so the anchoring subassembly 400 (and thus the latching element section 410) may be pulled out of hole. To accommodate this issue, the anchoring subassembly 400 may include a relaxation mechanism 460. The relaxation mechanism 460, in one or more embodiments, includes a shear feature 465 shearingly engaged between the connector sub 420 and an external retainer 490 (e.g., external retainer nut). In turn, the external retainer 490 is axially fixed to a latch sub 495, which in turn is axially fixed to the latch housing 440.

The relaxation mechanism 460, in at least one embodiment, further includes an internal retainer 470 (e.g., internal retainer nut threadingly coupled to the connector sub 420). The internal retainer 470, in one or more embodiments, creates a relaxation space 475. This relaxation space 475, in one or more embodiments, creates a distance that the spring member 450 may relax upon the shear feature 465 shearing. Accordingly, upon the shear feature 465 shearing the ramp member 455 is allowed to relax this same distance, thereby allowing the one or more latching features 445 to radially retract a related (e.g., but not always exactly equal) amount. In one or more embodiments, a relaxation spring 480 may be positioned in the relaxation space 475.

Figure 5:
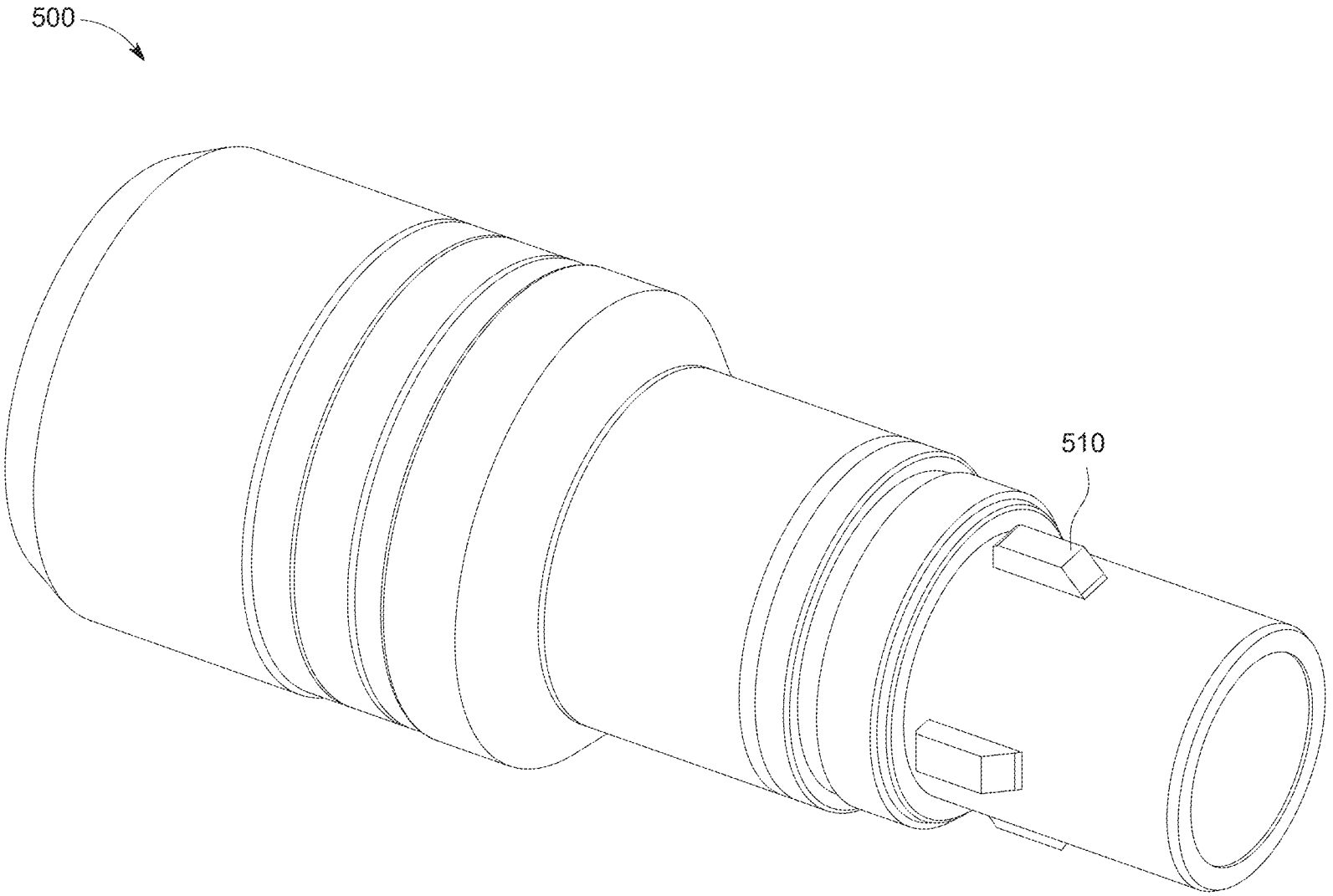
FIG. 5 illustrates one embodiment of a connector sub, the connector sub being similar in many respects to the connector sub of FIGS. 4A through 4C.

Turning to FIG. 5, illustrated is one embodiment of a connector sub 500, the connector sub 500 being similar in many respects to the connector sub 420 of FIGS. 4A through 4C. In the illustrated embodiment, the connector sub 500 includes one or more (e.g., a plurality) of keys 510.

Figure 6:
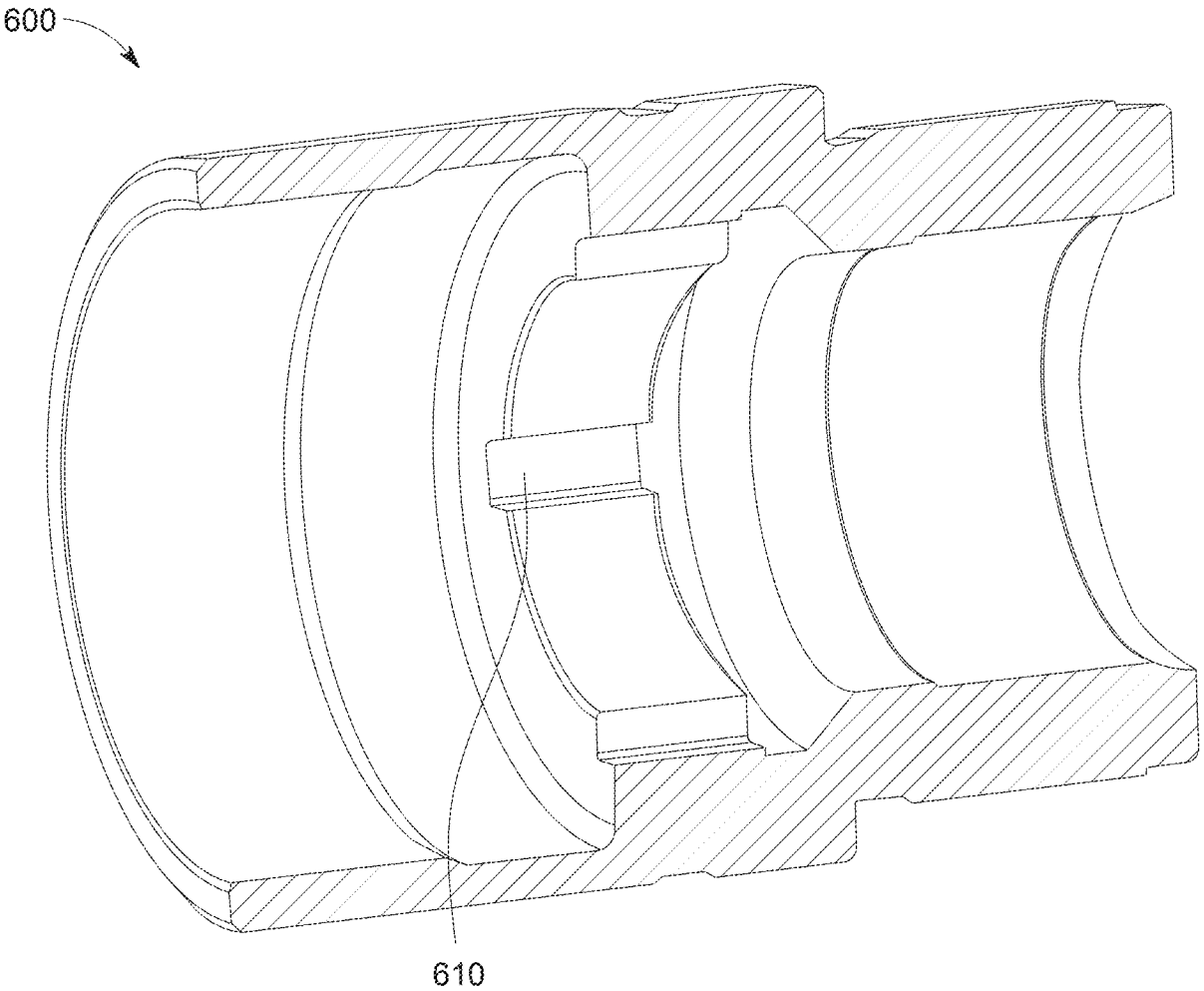
FIG. 6 illustrates one embodiment of a latch sub, the latch sub being similar in many respects to the latch sub of FIGS. 4A through 4C.

Turning to FIG. 6, illustrated is one embodiment of a latch sub 600, the latch sub 600 being similar in many respects to the latch sub 495 of FIGS. 4A through 4C. In the illustrated embodiment, the latch sub 600 includes one or more (e.g., a plurality) of key slots 610. In at least one embodiment, the one or more keys of the connector sub (e.g., one or more keys 510 of the connector sub 500) engage with the one or more key slots 610 of the latch sub 600. Accordingly, the one or more keys of the connector sub are allowed to axially slide relative to the one or more slots 610 of the latch sub 600, however, the one or more keys of the connector sub rotationally fix the connector sub to the latch sub 600.

Figure 7:
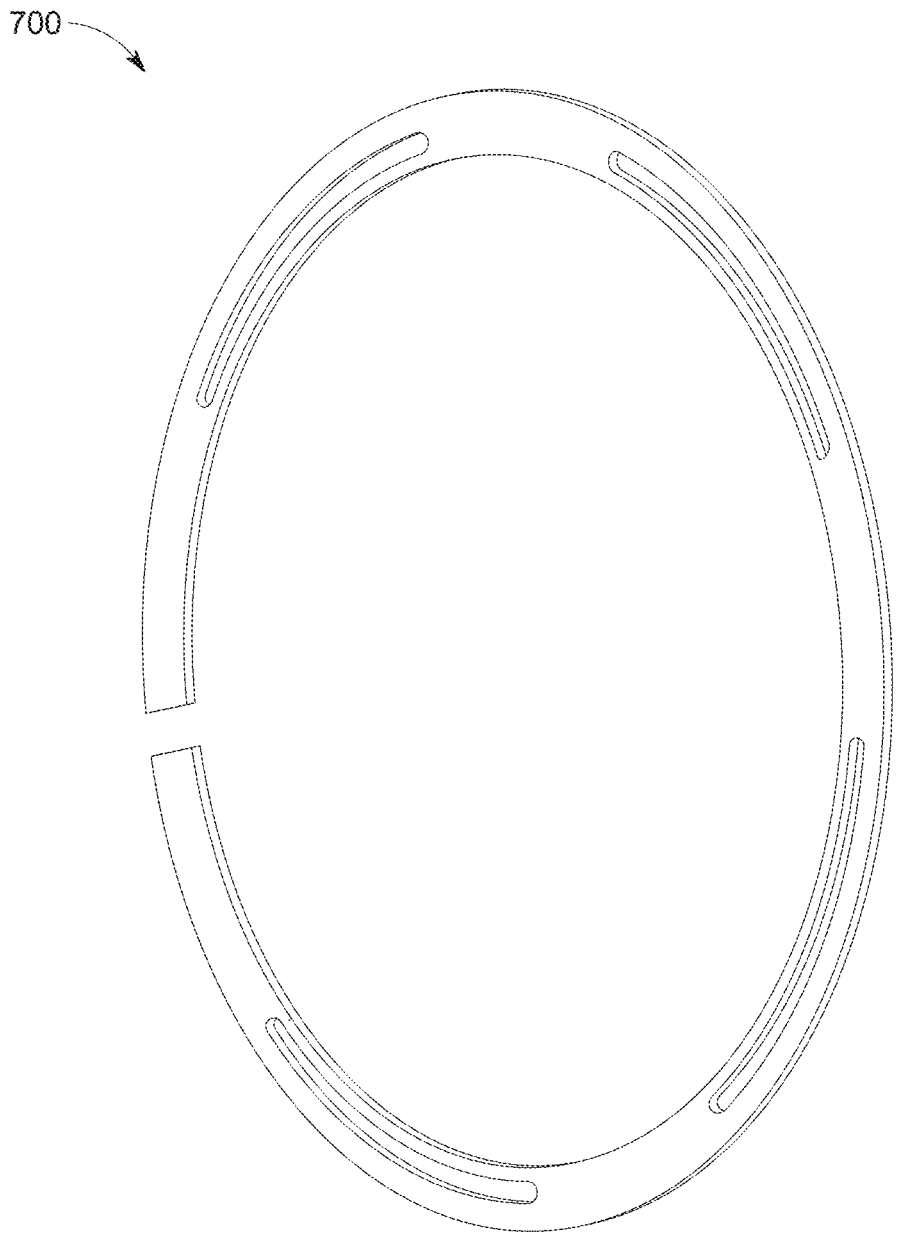
FIG. 7 illustrates one embodiment of a shear feature, the shear feature being similar in many respects to the shear feature of FIGS. 4A through 4C.

Turning to FIG. 7, illustrated is one embodiment of a shear feature 700, the shear feature 700 being similar in many respects to the shear feature 465 of FIGS. 4A through 4C. As those skilled in the art appreciate, the shear feature 700 may be specifically tailored to have a desired shear rating. Accordingly, the shear feature 700 can be specifically tailored to only shear after a specific amount of axial force (e.g., pull load) is applied to the shear feature 700, assuming that the one or more latching features have not already moved toward their radially retracted state.

Returning to FIGS. 4A through 4C, before assembling the anchoring subassembly 400, an operator would typically decide what pulling load is needed for the system. Again, depending on the angle (θ), the un-latch load may be higher, thus requiring a higher pulling load. In at least one embodiment, the shear rating of the shear feature 465 needs to be equal to or lower than the actual un-latch load. The shear ring rating can be reduced by simply making the shear feature 465 thinner. However, in certain embodiments a thinner shear ring would make the shear value not stable because it might act like a membrane. In at least one embodiment, a thicker shear ring 465 may be used, and the shear profile slot and/or material properties may be used to adjust the shear rating, and thus the shear rating can be predicted accurately. In at least one embodiment, when the anchoring subassembly 400 is run in hole, the external retainer 490 (e.g., external retainer nut) should be tightened and shouldered onto the shear feature 465 to lock it in position.

Turning to FIGS. 8A through 10C, illustrated is one embodiment for deploying, setting, relaxing and/or retrieving an anchoring subassembly 800 designed, manufactured and/or operated according to one or more embodiments of the disclosure. The anchoring subassembly 800 is similar in many respects to the anchoring subassembly 400 described and illustrated with respect to FIGS. 4A through 4C. Accordingly, like reference numbers have been used to illustrate similar features. The anchoring subassembly 800 includes a latching element section 410, a connector sub 420, and energizer sub 430, a latch housing 440, one or more latching features 445, a spring member 450, and a ramp member 455. The anchoring assembly 800 additionally includes a relaxation mechanism 460, a shear feature 465, an internal retainer 470, a relaxation space 475, a relaxation spring 480, an external retainer 490, and a latch sub 495.

Figure 8A:
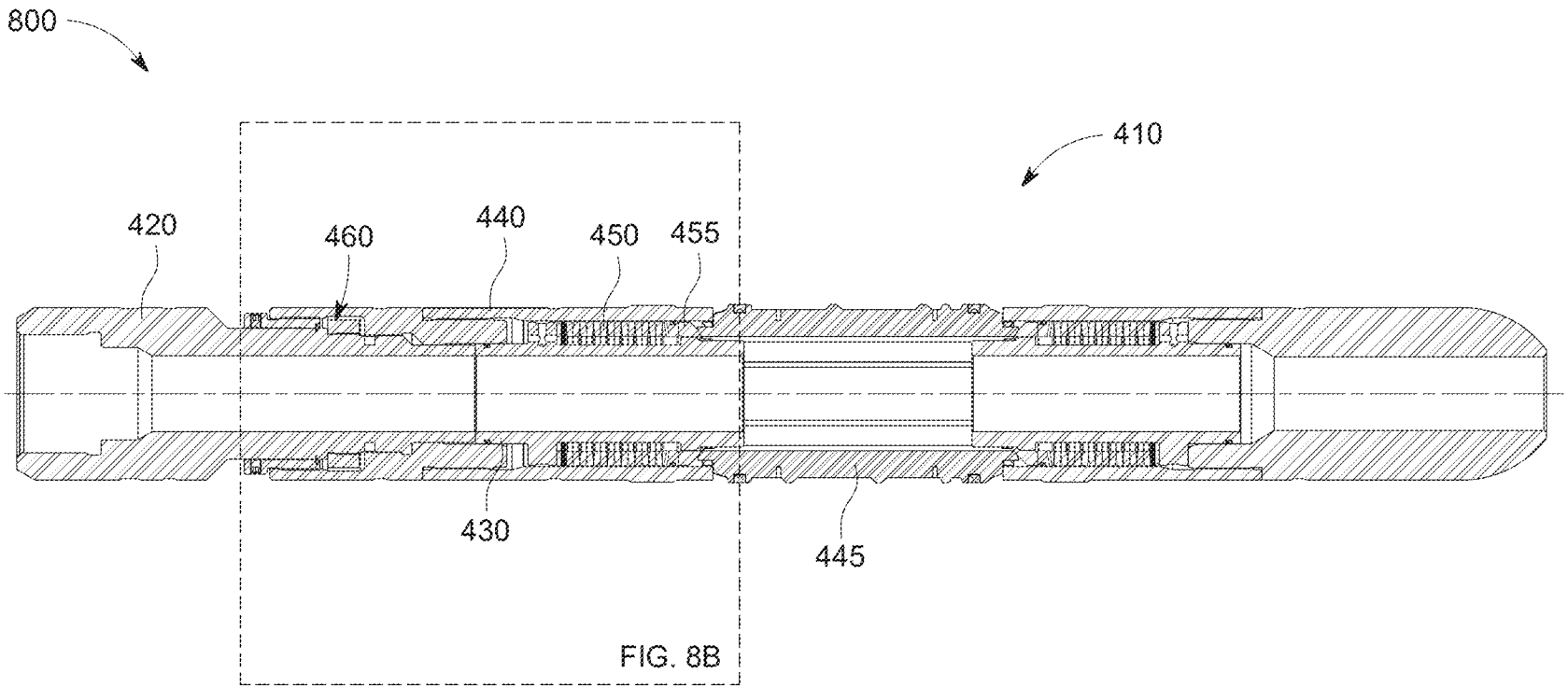
FIGS. 8A through 10C illustrate one embodiment for deploying, setting, relaxing and retrieving an anchoring subassembly designed, manufactured and/or operated according to one or more embodiments of the disclosure.
Figure 8B:
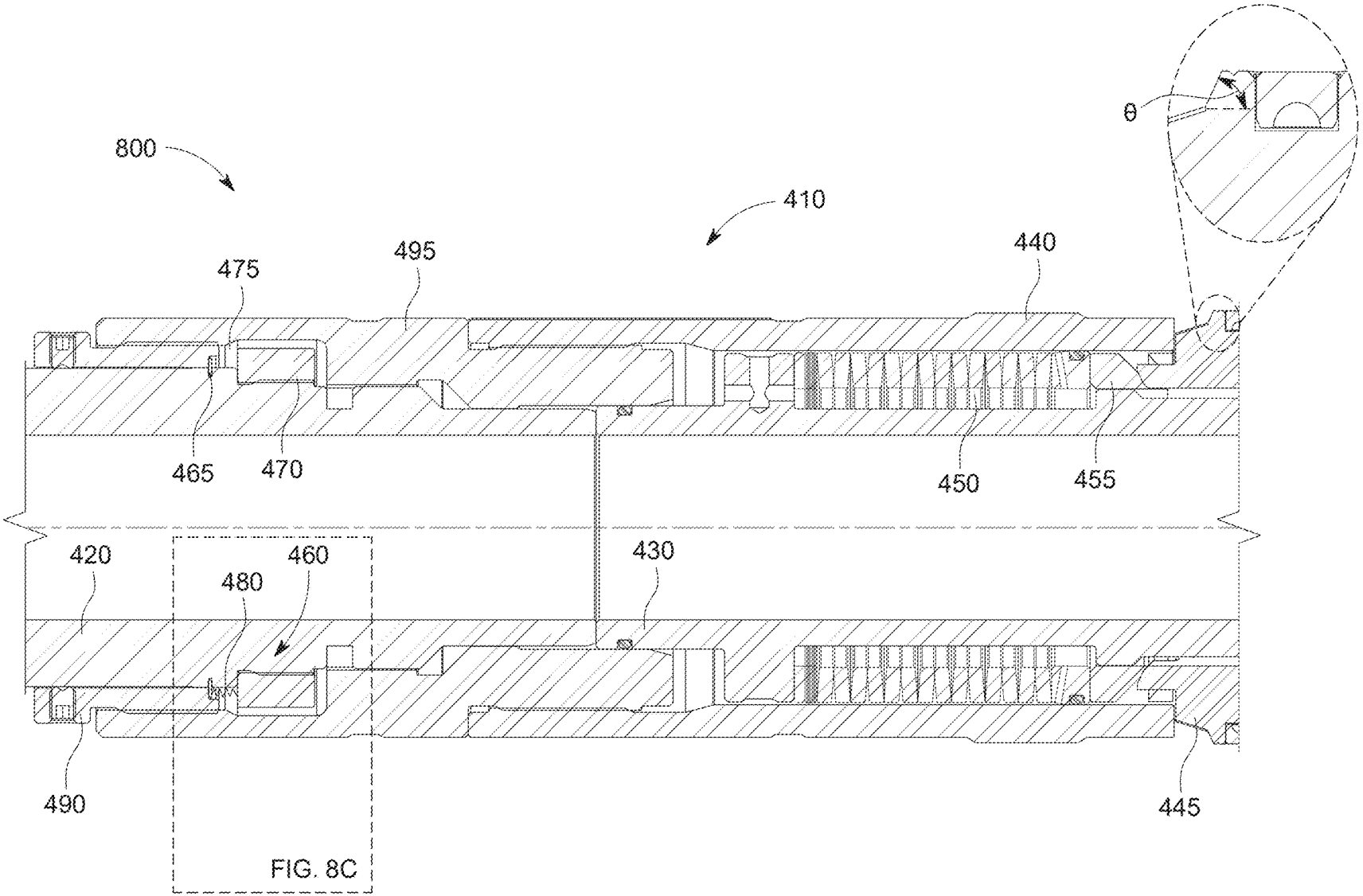
Figure 8C:
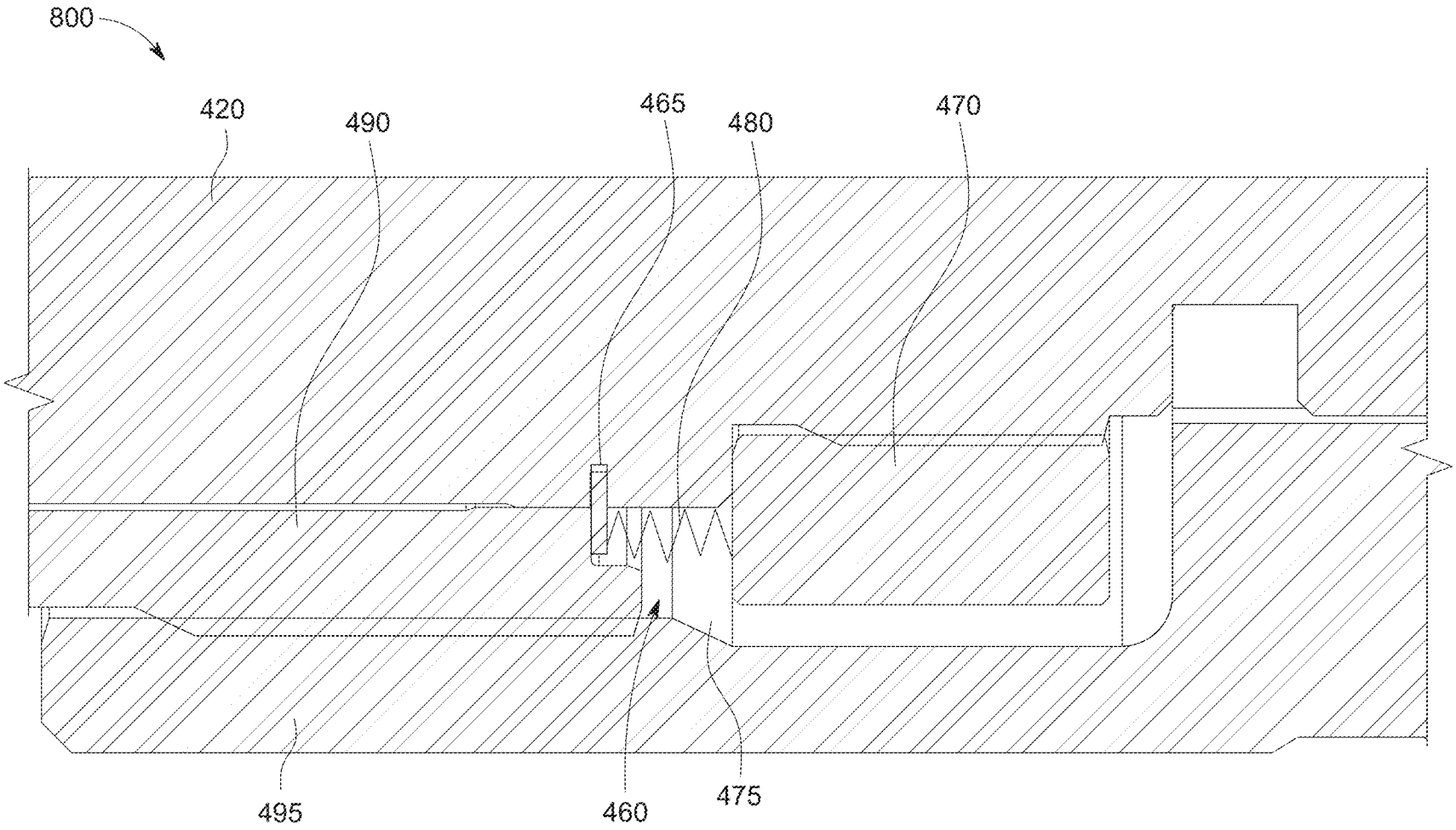

The anchoring subassembly 800 is run-in-hole, for example in the state shown in FIGS. 8A through 8C. Accordingly, the one or more latching features 445 may be in their radially retracted state, and thus will not catch on any wellbore features as the anchoring assembly 800 is being run-in-hole.

Figure 9A:
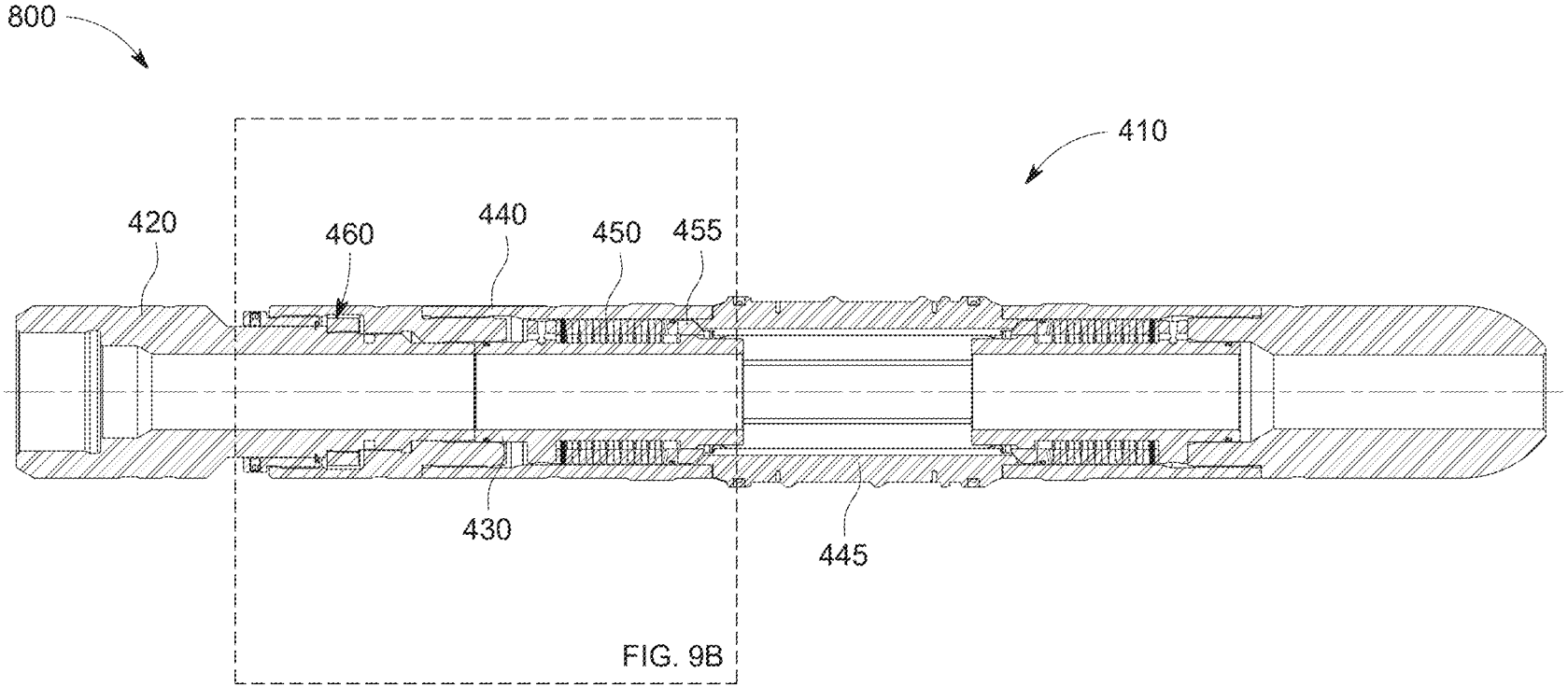
Figure 9B:
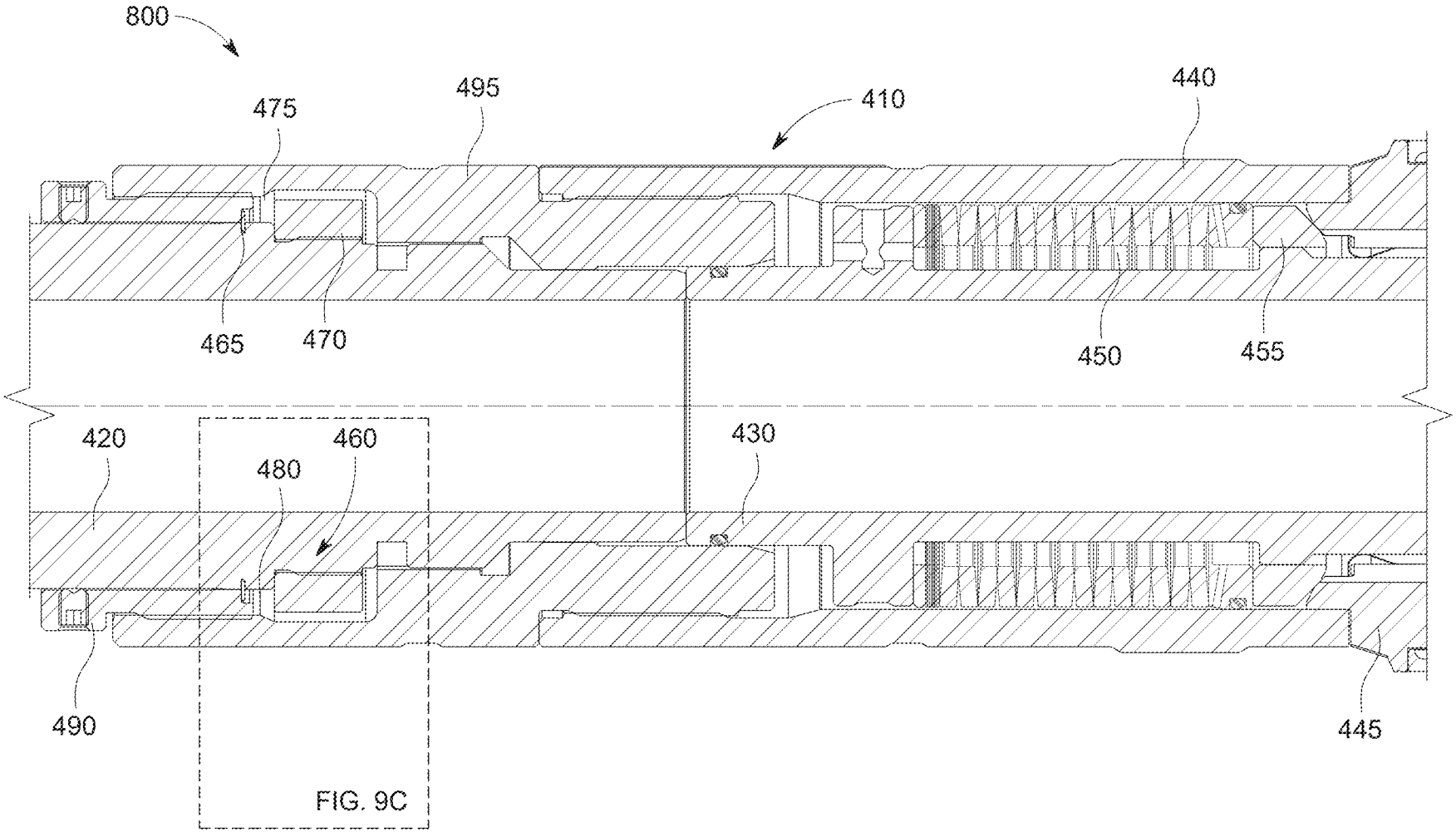
Figure 9C:
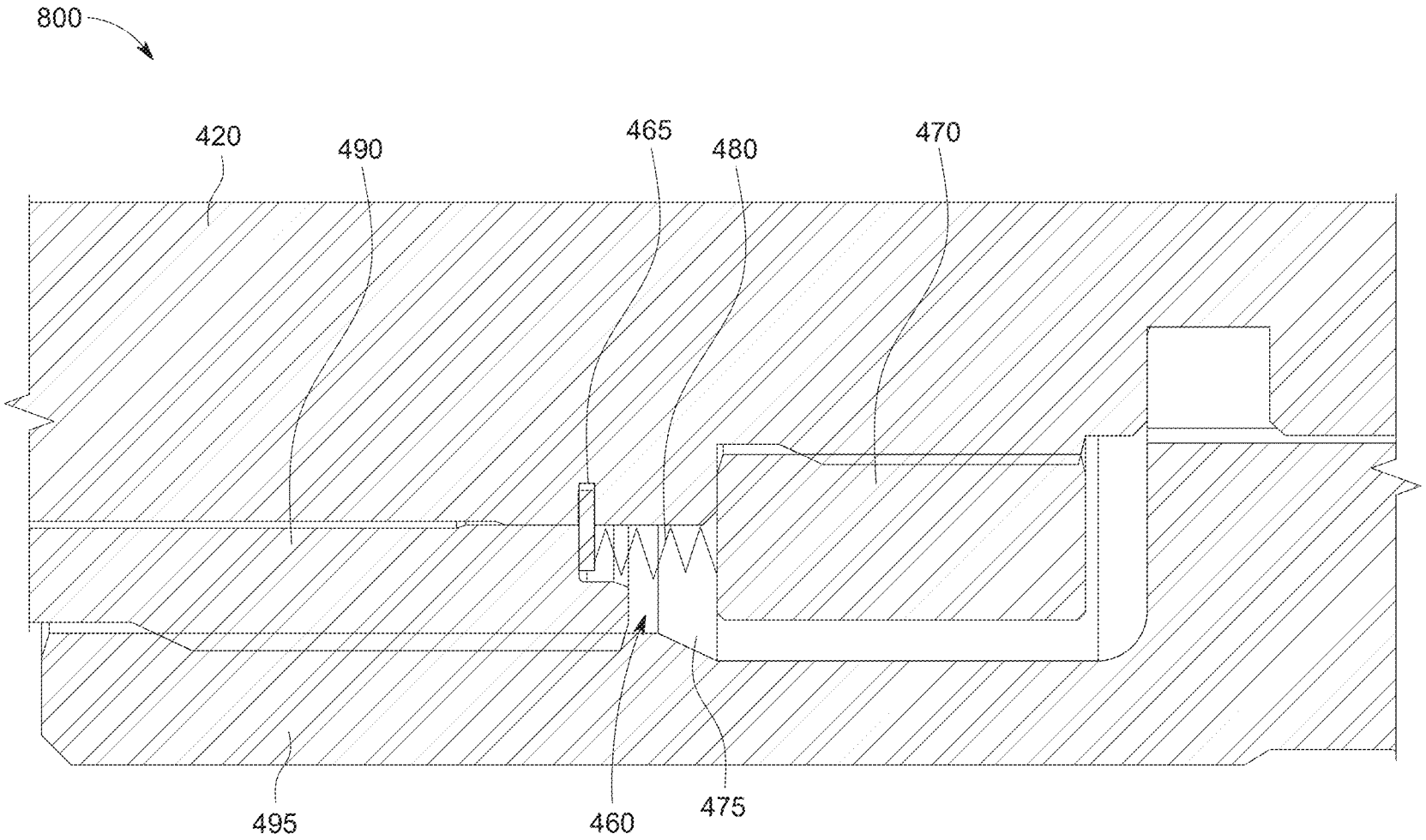

With the anchoring subassembly 800 run-in-hole to the proper depth, the one or more latching features 445 of the latching element section 410 may be set (e.g., as shown in FIGS. 9A through 9C). For example, the setting of the one or more latching features 445 may include putting down weight on the connector sub 420, which in turn puts down weight on the energizer sub 430, in turn compressing the spring member 450, and thus pushing the ramp member 455 downhole, thereby moving the one or more latching features 445 from their radially retracted state to their radially expanded state.

Figure 10A:
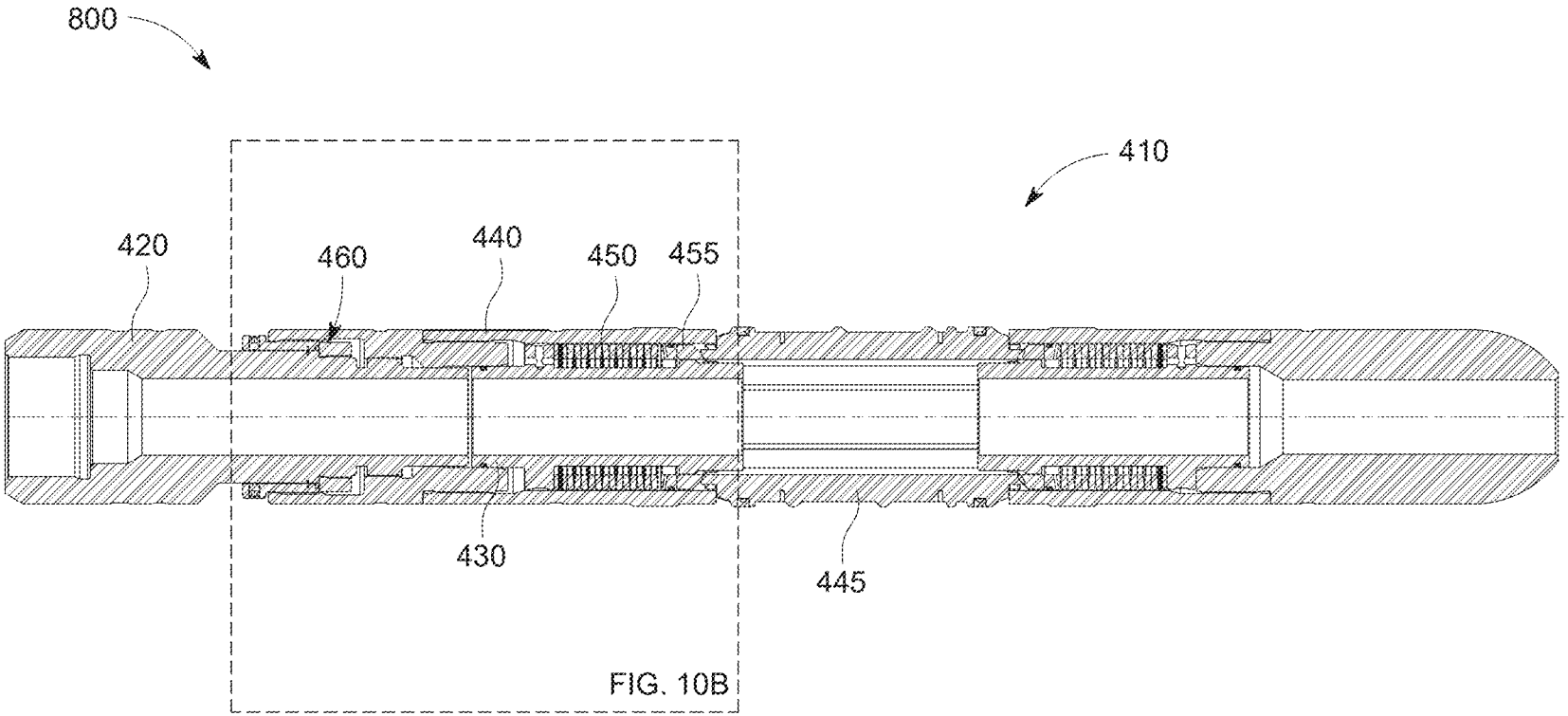
Figure 10B:
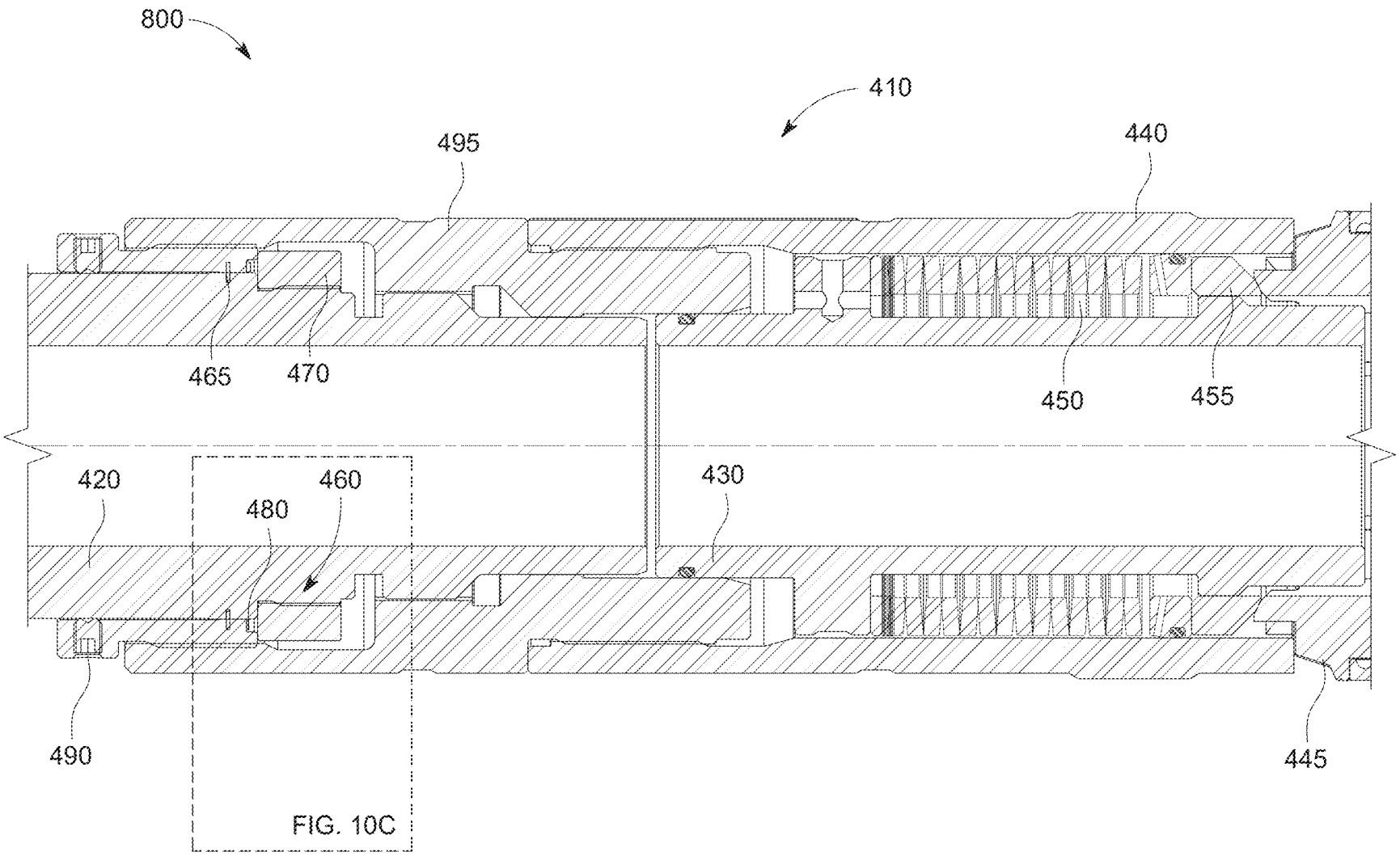
Figure 10C:
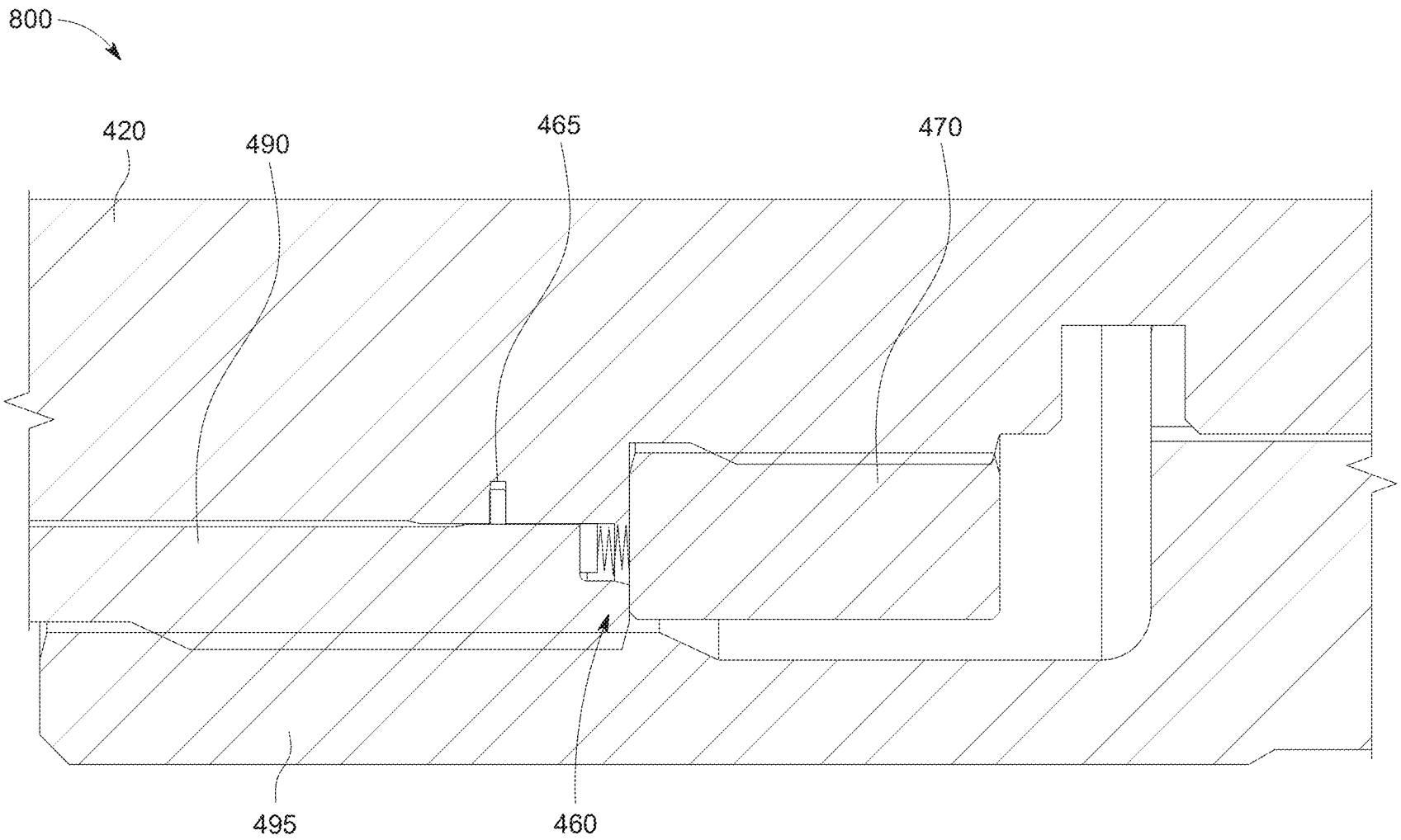

Turning to FIGS. 10A through 10C, when it is time to pull the anchoring subassembly 800 out of hole, if the one or more latching features 445 are stuck in the latch coupling of the casing, the operator may apply a straight pull load upon the connector sub 420. If the pull load is higher than the shear rating of the shear feature 465, the shear feature 465 will shear first. Accordingly, in at least one embodiment the connector sub 420 would carry the internal retainer 470 uphole until its shoulders on the external retainer 460.

As the connector sub 420 moves upwards, the spring member 450 (e.g., which is in compression) is allowed to push the latch sub 430 upwards. As the latch sub 430 moves upwards, the ramp member 455 is allowed to relax a bit, which allows the one or more latching features 445 to move toward their radially retracted state (e.g., with a much smaller pulling force). In at least one embodiment, the relaxation gap 475 should be controlled to a value such that the one or more latching features 445 will not fully collapse and fall into the wellbore while pulling the anchoring subassembly 800 out of the wellbore.

The relaxation mechanism 460, in one or more embodiments, is a contingency mechanism that is helpful in the case that the one or more latching features 445 get stuck, for example due to cement. In the case of normal operation, the shear feature 465 of the relaxation mechanism 460 will remain intact during un-latch and pull out, and thus can be re-used for subsequent runs. However, the relaxation mechanism is extremely helpful to have so that even in the case that the anchoring subassembly 800 gets initially stuck in hole, no additional trips are added to address the stuck anchoring subassembly 800 (e.g., additional fishing runs, etc.), which is a significant time and cost savings.

Aspects disclosed herein include:

A. An anchoring subassembly, the anchoring subassembly including: 1) a connector sub;

an energizer sub that is in sliding engagement with the connector sub; 2) a latch housing; 3) one or more latching features supported by the latch housing, the one or more latching features operable to move between a radially retracted state and a radially expanded state; 4) a spring member positioned within a space between the latch housing and the energizer sub; 5) a ramp member positioned within the space between the latch housing and the energized sub and between the spring member and the one or more latching features; and 6) a relaxation mechanism coupled to the connector sub, the relaxation mechanism configured to relax to allow the one or more latching features to return toward their radially retracted state.

B. A well system, the well system including: 1) a main wellbore located in a subterranean formation; 2) a lateral wellbore extending from the main wellbore; and 3) a whipstock assembly including an anchoring subassembly positioned proximate an intersection between the main wellbore and the lateral wellbore, the anchoring subassembly including: a) a connector sub; b) an energizer sub that is in sliding engagement with the connector sub; c) a latch housing; d) one or more latching features supported by the latch housing, the one or more latching features operable to move between a radially retracted state and a radially expanded state; e) a spring member positioned within a space between the latch housing and the energizer sub; f) a ramp member positioned within the space between the latch housing and the energized sub and between the spring member and the one or more latching features; and g) a relaxation mechanism coupled to the connector sub, the relaxation mechanism configured to relax to allow the one or more latching features to return toward their radially retracted state.

C. A method, the method including: 1) positioning a whipstock assembly including an anchoring subassembly proximate an intersection between a main wellbore and a lateral wellbore, the anchoring subassembly including: a) a connector sub; b) an energizer sub that is in sliding engagement with the connector sub; c) a latch housing; d) one or more latching features supported by the latch housing, the one or more latching features operable to move between a radially retracted state and a radially expanded state; e) a spring member positioned within a space between the latch housing and the energizer sub; f) a ramp member positioned within the space between the latch housing and the energized sub and between the spring member and the one or more latching features; and g) a relaxation mechanism coupled to the connector sub, the relaxation mechanism configured to relax to allow the one or more latching features to return toward their radially retracted state; 2) setting the anchoring assembly, the setting causing the one or more latch features to move from their radially retraced to state to their radially expanded state to engage with a latch coupling of a wellbore tubular; and 3) relaxing the relaxation mechanism after setting the anchoring assembly, the relaxing allowing the one or more latching features to return toward their radially retracted state.

Aspects A, B, and C may have one or more of the following additional elements in combination: Element 1: wherein the relaxation mechanism includes a shear feature shearingly engaged between the connector sub and an external retainer. Element 2: wherein the external retainer is an external retainer nut. Element 3: wherein the external retainer is axially fixed to a latch sub, the latch sub being axially fixed to the latch housing. Element 4: further including an internal retainer located in a space between the connector sub and the latch sub. Element 5: wherein the internal retainer is a threaded internal retainer, the threaded internal retainer threadingly engaged with the connector sub. Element 6: further including a relaxation space positioned between the internal retainer and the external retainer, the relaxation space defining a distance the spring member may relax upon shearing of the shear feature. Element 7: further including a relaxation spring located in the relaxation space. Element 8: wherein the one or more latching features include a latch angle (θ) of greater than 45 degrees. Element 9: wherein the one or more latching features include a latch angle (θ) of greater than 60 degrees.

Those skilled in the art to which this application relates will appreciate that other and further additions, deletions, substitutions and modifications may be made to the described embodiments.

What is claimed is:

1. An anchoring subassembly, comprising:

a connector sub;

an energizer sub that is in sliding engagement with the connector sub;

a latch housing;

one or more latching features supported by the latch housing, the one or more latching features operable to move between a radially retracted state and a radially expanded state;

a spring member positioned within a space between the latch housing and the energizer sub;

a ramp member positioned within the space between the latch housing and the energized sub and between the spring member and the one or more latching features;

a relaxation mechanism coupled to the connector sub, the relaxation mechanism configured to relax to allow the one or more latching features to return toward their radially retracted state, wherein the relaxation mechanism includes a shear feature shearingly engaged between the connector sub and an external retainer; and an internal retainer located in a space between the connector sub and the latch sub.

2. The anchoring subassembly as recited in claim 1, wherein the external retainer is an external retainer nut.

3. The anchoring subassembly as recited in claim 1, wherein the external retainer is axially fixed to a latch sub, the latch sub being axially fixed to the latch housing.

4. The anchoring subassembly as recited in claim 1, wherein the internal retainer is a threaded internal retainer, the threaded internal retainer threadingly engaged with the connector sub.

5. The anchoring subassembly as recited in claim 1, further including a relaxation space positioned between the internal retainer and the external retainer, the relaxation space defining a distance the spring member may relax upon shearing of the shear feature.

6. The anchoring subassembly as recited in claim 5, further including a relaxation spring located in the relaxation space.

7. The anchoring subassembly as recited in claim 1, wherein the one or more latching features include a latch angle (θ) of greater than 45 degrees.

8. The anchoring subassembly as recited in claim 1, wherein the one or more latching features include a latch angle (θ) of greater than 60 degrees.

9. A well system, comprising:

a main wellbore located in a subterranean formation;

a lateral wellbore extending from the main wellbore; and a whipstock assembly including an anchoring subassembly positioned proximate an intersection between the main wellbore and the lateral wellbore, the anchoring subassembly including:

a connector sub;

an energizer sub that is in sliding engagement with the connector sub;

a latch housing;

one or more latching features supported by the latch housing, the one or more latching features operable to move between a radially retracted state and a radially expanded state;

a spring member positioned within a space between the latch housing and the energizer sub;

a ramp member positioned within the space between the latch housing and the energized sub and between the spring member and the one or more latching features;

a relaxation mechanism coupled to the connector sub, the relaxation mechanism configured to relax to allow the one or more latching features to return toward their radially retracted state, wherein the relaxation mechanism includes a shear feature shearingly engaged between the connector sub and an external retainer; and an internal retainer located in a space between the connector sub and the latch sub.

10. The well system as recited in claim 9, wherein the external retainer is an external retainer nut.

11. The well system as recited in claim 9, wherein the external retainer is axially fixed to a latch sub, the latch sub being axially fixed to the latch housing.

12. The well system as recited in claim 9, wherein the internal retainer is a threaded internal retainer, the threaded internal retainer threadingly engaged with the connector sub.

13. The well system as recited in claim 9, further including a relaxation space positioned between the internal retainer and the external retainer, the relaxation space defining a distance the spring member may relax upon shearing of the shear feature.

14. The well system as recited in claim 13, further including a relaxation spring located in the relaxation space.

15. The well system as recited in claim 9, wherein the one or more latching features include a latch angle (θ) of greater than 45 degrees.

16. The well system as recited in claim 9, wherein the one or more latching features include a latch angle (θ) of greater than 60 degrees.

17. A method, comprising:

positioning a whipstock assembly including an anchoring subassembly proximate an intersection between a main wellbore and a lateral wellbore, the anchoring subassembly including:

a connector sub;

an energizer sub that is in sliding engagement with the connector sub;

a latch housing;

one or more latching features supported by the latch housing, the one or more latching features operable to move between a radially retracted state and a radially expanded state;

a spring member positioned within a space between the latch housing and the energizer sub;

a ramp member positioned within the space between the latch housing and the energized sub and between the spring member and the one or more latching features;

a relaxation mechanism coupled to the connector sub, the relaxation mechanism configured to relax to allow the one or more latching features to return toward their radially retracted state, wherein the relaxation mechanism includes a shear feature shearingly engaged between the connector sub and an external retainer; and an internal retainer located in a space between the connector sub and the latch sub;

setting the anchoring assembly, the setting causing the one or more latch features to move from their radially retraced to state to their radially expanded state to engage with a latch coupling of a wellbore tubular; and relaxing the relaxation mechanism after setting the anchoring assembly, the relaxing allowing the one or more latching features to return toward their radially retracted state.

* * * * *